US009200422B2

(12) United States Patent
Hakkinen et al.

(10) Patent No.: US 9,200,422 B2
(45) Date of Patent: Dec. 1, 2015

(54) METHOD AND ARRANGEMENT FOR SUPPORTING STRUCTURE

(75) Inventors: Sami Hakkinen, Tampere (FI); Tuomas Lievonen, Nokia (FI); Antti Perala, Littoinen (FI)

(73) Assignee: Uretek Worldwide OY, Pirkkala (FI)

( * ) Notice: Subject to any disclaimer, the term of this patent is extended or adjusted under 35 U.S.C. 154(b) by 0 days.

(21) Appl. No.: 13/995,806

(22) PCT Filed: Dec. 19, 2011

(86) PCT No.: PCT/FI2011/051131

§ 371 (c)(1),
(2), (4) Date: Oct. 4, 2013

(87) PCT Pub. No.: WO2012/085342

PCT Pub. Date: Jun. 28, 2012

(65) Prior Publication Data

US 2014/0017015 A1 Jan. 16, 2014

(30) Foreign Application Priority Data

Dec. 20, 2010 (FI) ..... 20106346

(51) Int. Cl.

| | |
|---|---|
| ***E02D 3/12*** | (2006.01) |
| ***E02D 5/46*** | (2006.01) |
| ***E02D 27/34*** | (2006.01) |

(52) U.S. Cl.

CPC . *E02D 5/46* (2013.01); *E02D 27/34* (2013.01)

(58) Field of Classification Search

USPC ..... 405/232, 233, 236, 263, 266; 52/169.1, 52/169.9, 741.15, 167.1

See application file for complete search history.

(56) References Cited

U.S. PATENT DOCUMENTS

| | | | |
|---|---|---|---|
| RE25,614 | E | 7/1964 | Turzillo |
| 4,309,129 | A | 1/1982 | Takahashi |

(Continued)

FOREIGN PATENT DOCUMENTS

| | | | |
|---|---|---|---|
| EP | 851064 | A1 | 7/1998 |
| EP | 1314824 | A1 | 5/2003 |

(Continued)

OTHER PUBLICATIONS

International Search Report and Written Opinion for International Application No. PCT/FI2011/050344 filed Apr. 18, 2011, mailed Oct. 25, 2011. 9 pages.

(Continued)

*Primary Examiner* — Sean Andrish

(74) *Attorney, Agent, or Firm* — Charles A. Weiss; Nicholas P. Chiara; Holland & Knight LLP

(57) ABSTRACT

Method and arrangement for supporting a structure. Beneath the structure there is arranged a cohesion structure, which transfers the structure load through shaft adhesion to surrounding ground. The cohesion structure includes an expansion element having a wall of flexible material, inside which there is injected along an injecting pipe unreacted polymer, which reacts in the expansion element. The expansion element with the reacted polymer therein constitutes the cohesion pillar. The polymer is water absorbing material and the wall of the expansion element is of water-permeable material, whereby the cohesion pillar is arranged to absorb water from the surrounding ground so as to improve the adhesion between the expansion element and the surrounding ground.

10 Claims, 1 Drawing Sheet

(56) References Cited

U.S. PATENT DOCUMENTS

| | | | | | |
|---|---|---|---|---|---|
| 4,380,408 | A | * | 4/1983 | Loken et al. | 405/263 |
| 4,487,528 | A | | 12/1984 | Skogberg | |
| 4,966,237 | A | | 10/1990 | Swanson et al. | |
| 5,106,423 | A | | 4/1992 | Clarke | |
| 5,256,004 | A | | 10/1993 | Gemmi et al. | |
| 5,836,390 | A | * | 11/1998 | Apps et al. | 166/281 |
| 5,911,545 | A | * | 6/1999 | Heitkamp | 405/275 |
| 6,634,831 | B2 | | 10/2003 | Canteri | |
| 6,948,881 | B1 | | 9/2005 | Fredriksson et al. | |
| 7,789,591 | B2 | | 9/2010 | Hakkinen et al. | |
| 2001/0041100 | A1 | | 11/2001 | McCabe et al. | |
| 2005/0117975 | A1 | * | 6/2005 | England et al. | 405/229 |
| 2006/0104723 | A1 | | 5/2006 | Shiraishi | |
| 2009/0155002 | A1 | | 6/2009 | Hakkinen et al. | |
| 2013/0051929 | A1 | | 2/2013 | Hakkinen et al. | |
| 2013/0129423 | A1 | | 5/2013 | Hakkinen et al. | |

FOREIGN PATENT DOCUMENTS

| | | | | |
|---|---|---|---|---|
| FI | 20065379 | A | | 12/2007 |
| JP | 57081516 | A | | 5/1982 |
| JP | 59-027020 | | | 2/1984 |
| JP | 59-48518 | A | | 3/1984 |
| JP | 59-130910 | A | | 7/1984 |
| JP | 61165411 | | | 7/1986 |
| JP | 61165411 | | * | 10/1986 |
| JP | 01-154913 | | | 6/1989 |
| JP | 1-158108 | A | | 6/1989 |
| JP | 3-87412 | A | | 4/1991 |
| JP | 04-140316 | | | 5/1992 |
| JP | 6-10336 | A | | 1/1994 |
| JP | 07-238531 | | | 9/1995 |
| JP | 7259103 | | | 10/1995 |
| JP | 08-041857 | | | 2/1996 |
| JP | 2002-294685 | | | 10/2002 |
| JP | 2003055949 | | | 2/2003 |
| JP | 2003105745 | | | 4/2003 |
| JP | 2004-156290 | A | | 6/2004 |
| JP | 2005-248501 | A | | 9/2005 |
| JP | 2006028946 | A | | 2/2006 |
| JP | 2006-328816 | | | 12/2006 |
| NL | 9300394 | A | | 10/1994 |
| WO | 91/04376 | A1 | | 4/1991 |
| WO | 2007141384 | | | 12/2007 |

OTHER PUBLICATIONS

International Preliminary Report on Patentability for PCT/FI2007/050321 dated Sep. 30, 2008.

International Preliminary Report on Patentability for PCT/FI2011/050344 mailed Nov. 1, 2012.

International Preliminary Report on Patentability for PCT/FI2011/051131 mailed Jul. 4, 2013.

International Search Report and Written Opinion for International Application No. PCT/FI2007/050321 mailed Oct. 4, 2007.

International Search Report for International Application No. PCT/FI2011/050103 filed Feb. 7, 2011, mailed May 27, 2011. 5 pages.

Aho, Hanna, National Board of Patents and Registration of Finland, "International Search Report and Written Opinion" issued in PCT/FI2011/051131 on Mar. 19, 2012 and as published in WO 2012/085342 on Jun. 28, 2012.

* cited by examiner

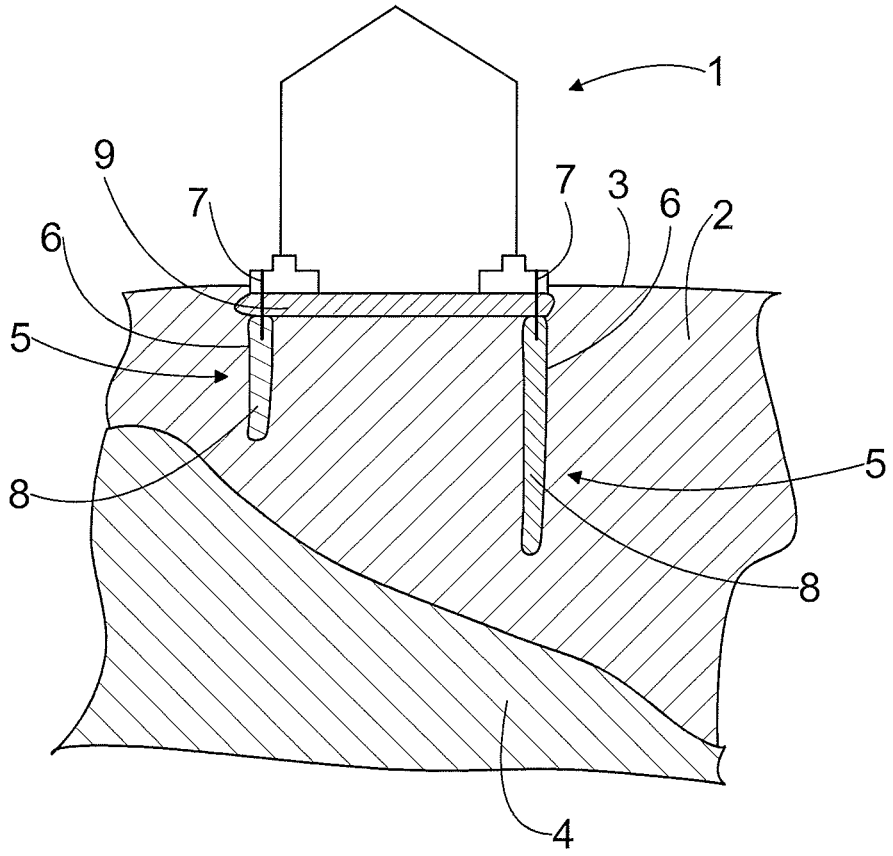
1
9
7
7
3
6
2
6
5
5
8
8
4

METHOD AND ARRANGEMENT FOR SUPPORTING STRUCTURE

CROSS-REFERENCE TO RELATED APPLICATIONS

This application is the U.S. National Stage of International (PCT) Patent Application No. PCT/FI2011/051131, filed on Dec. 19, 2011, which claims priority to Finish Patent Application No. 20106346, filed on Dec. 20, 2010. The entire disclosures of these applications are incorporated herein by reference in their entireties.

BACKGROUND OF THE INVENTION

The invention relates to a method for supporting a structure, in which method there is arranged below the structure a cohesion structure, which transfers the structure load through shaft adhesion to surrounding ground and the structure to be supported is arranged to be supported to said cohesion structure.

The invention further relates to an arrangement for supporting a structure, which arrangement includes a cohesion structure, which transfers the structure load through shaft adhesion to surrounding ground and which cohesion structure is arranged below the structure, whereby the structure is arranged to be supported to said cohesion structure.

Structures are typically supported with support piles and friction piles. The lower tip of a support pile is supported, for instance, on a rock or a dense bottomset bed. Thus, the support pile transfers major part of its load through the tip onto the rock or the dense bottomset bed. Friction piles are typically used when the rock or the dense bottomset bed is covered by a thick earth layer of moraine or other coarse-structured material. The friction pile transfers major part of the load through shaft friction to an earth layer surrounding it. In case the use of the support or friction pile is not possible, for instance, due to the fact that the distance between the ground surface and the rock, the dense bottomset bed or an earth layer suitable for the friction pile is large, it is possible to use a cohesion pile for supporting the structure. The cohesion pile transfers the pile load through adhesion created on its skin surface. Typically, the ground where a cohesion pile is used is compressive. Consequently, it is challenging to render sufficient the adhesion of the cohesion pile and the ground surrounding it. An example of a cohesion pile is disclosed in publication WO 91/04376.

The pile may be made, for instance, of wood, steel or concrete. A wooden pile is subjected to decay because of moisture in the soil and variation therein. On the other hand, concrete and steel piles are subjected to corrosion and the erosive effect, for instance, of chemicals in the soil.

BRIEF DESCRIPTION OF THE INVENTION

It is an object of the present invention to provide a new type of solution for supporting a structure.

The method of the invention is characterized by determining shearing strength of the surrounding ground and providing a cohesion structure such that in the ground there is arranged an expansion element having a wall of flexible material, feeding along an injecting pipe into the expansion element unreacted polymer which reacts in the expansion element, and absorbing water with the polymer from the ground surrounding the cohesion pillar so as to improve the adhesion between the expansion element and the surrounding ground, whereby the expansion element, inside which there is said reacted polymer, forms the cohesion pillar.

Further, the arrangement of the invention is characterized in that the cohesion structure includes an expansion element having a wall of flexible material and inside which there is injected along an injecting pipe unreacted polymer, which is reacted in the expansion element, and the polymer is water absorbing material and the wall of the expansion element is of water-permeable material, whereby the cohesion pillar is arranged to absorb water from the surrounding ground so as to improve the adhesion between the expansion element and the surrounding ground and whereby the cohesion structure provided by the expansion element and the reacted polymer therein constitutes the cohesion pillar.

In the present solution, there is arranged below the structure a cohesion structure that transfers the load acting thereon through shaft adhesion to the surrounding ground. The structure to be supported is arranged to support to the cohesion structure. The cohesion structure consists of an expansion element whose wall is of flexible material and inside which there is injected, along an injecting pipe, unreacted polymer that reacts in the expansion element. Said polymer is preferably such that, when reacted, it is elastic. The expansion element, inside which there is reacted polymer, constitutes a cohesion pillar. A cohesion pillar differs from a cohesion pile in that, prior to setting into place, the cohesion pile has accurately defined, specific strength properties, i.e. the cohesion pile has predetermined dimensions and materials. Whereas the final dimensions of the cohesion pillar used in the invention are not known for sure prior to installation in the ground and formation, because said cohesion pillar is formed in its final location in the ground, and for instance, properties of the surrounding ground, such as its compressive strength, affect the dimensions of the expansion element. On the other hand, moisture in the ground may affect the properties of the polymer inside the expansion element of the cohesion pillar. Naturally, the calculated initial values of the cohesion pillar of the invention can be determined as desired, but each installation site may be determined individually, for instance, in view of water absorption and formation of the elastic wall of the expansion element in the ground. Preferably the expansion element including elastic material is designed such that its elasticity is close to the compressibility of the surrounding ground, however, such that the cohesion pillar will retain sufficient, designed structural bearing capacity. In this manner the adhesion between the cohesion pillar and the ground surrounding it will persist very well. Thanks to the elasticity of the cohesion pillar, the structure is also partly carried by the ground, because the elastic cohesion pillar yields slightly. All in all, subsidence of a structure will be at least slowed down effectively. Because the cohesion pillar is provided by installing in the ground first only an injecting pipe and an expansion element, and only after they are in place, polymer is fed into the expansion element, whereby the expansion element does not expand into its final form until it is inside the ground, and therefore the installation of the cohesion pillar is simple and the equipment required for the installation of the column are light. All things considered, the installation disturbs the ground, in the vicinity of its surface, very little. On the other hand, while expanding in the ground the expansion element pushes earth particles away from one another. It is possible that this produces a vacuum reaction, which improves adhesion between the cohesion pillar and the ground. The vacuum reaction may also compensate for a rise in piezometric level caused by the expanding column. Further, thanks to the polymer in the cohesion pillar there will occur no decay or corrosion problems, and it is also possible to avoid problems that might be caused by erosive chemicals occurring in the ground.

The polymer in the expansion element is such that it absorbs water from the surrounding ground. At least main part of the absorption takes place during the polymer reaction. The absorption generates a suction effect, i.e. the cohesion pillar sucks the surrounding ground towards itself and thus increases the adhesion between the cohesion pillar and the ground. Further, the polymer is preferably porous, whereby it is able to absorb water effectively. The effect of the absorbed water may increase the total mass of the cohesion pillar by up to 100%. In other words, by the effect of the water the total mass of the cohesion pillar may even double. The desired absorption amount may be determined on the basis of the shearing strength of the ground. The larger the absorption amount, the better the adhesion between the cohesion pillar and the ground. The lower the determined shearing strength, the larger the desired absorption amount is to be determined.

The idea of an embodiment is that the chemical reaction of the polymer is arranged to produce heat such that said chemical reaction dries the surrounding ground. In this manner it is also possible to improve adhesion between the cohesion pillar and the ground.

The idea of a second embodiment is that the structure be supported is an existing structure through which an expansion element and an injecting pipe are arranged. The polymer will be injected through the injecting pipe and it does not react until in the expansion element. Thus, there is only a relatively small hole that needs to be arranged through the structure, whereby the installation of the cohesion pillar will not cause substantial harm to the existing structures.

BRIEF DESCRIPTION OF THE FIGURES

The invention is described in greater detail in the attached FIG. 1, which shows schematically how a structure is supported by cohesion pillars.

For the sake of clarity, the figures show some embodiments of the invention in a simplified manner.

DETAILED DESCRIPTION OF THE INVENTION

FIG. 1 shows a building 1, which is arranged on a compressive ground 2. The compressive ground 2 may be clay, for instance. The distance from the ground surface 3 to a hard ground, such as rock 4, is so long that the building 1 rests on cohesion pillars 5.

The cohesion pillar 5 is formed by an expansion element 6, inside which there is injected polymer 8 along an injecting pipe 7. The polymer 8 is preferably such that, when reacted, it is elastic. Further, the polymer 8 is such that it absorbs water from the surrounding ground. Further, the polymer 8 is preferably porous such that it provides a so-called sponge effect, whereby it is able to absorb water effectively. As water is absorbed into the expansion element 6 from the surrounding ground, naturally a wall of the expansion element 6 is to be of water-permeable material. The wall of the expansion element is to be flexible, yet preferably substantially non-stretching material. A good material suitable for the purpose is a geotextile.

The polymer 8 is such that unreacted it is fluent, i.e. it can be injected unreacted along the injecting pipe 7 into the expansion element 6. The polymer 8 reacts in the expansion element 6. The reaction of the polymer 8, i.e. its chemical reaction comprises at least solidification and/or hardening thereof.

Further preferably, the chemical reaction of the polymer is arranged to produce heat. In that case, said chemical reaction enables the ground 2 surrounding the expansion element 6 to be dried.

The cohesion pillar 5 may be secured to the structure to be supported through the injection pipe 7. On the other hand, instead of or in addition to the injecting pipe 7, the expansion element 6 may be connected to support directly to the structure to be supported.

When the polymer 8 is injected, the injecting pipe 7 may be first arranged at the bottom of the expansion element 6, and in the course of injection, the injecting pipe may be drawn upwardly, and finally, the injecting pipe 7 may be drawn out altogether, if so desired, from the inside of the expansion element 6. Thus, in this case the expansion element 6 and the polymer 8 therein constitute the cohesion pillar 5, without any other structures.

The cohesion pillar 5 is thus formed preferably such that first is expanded the lower part of the expansion element 6. Only thereafter the polymer 8 is injected such that the expansion element 6 is filled up from bottom upwards. The expanded portion of the lower part of the expansion element 6 anchors the cohesion pillar in the ground, which enables the injecting pipe 7 being drawn upwardly without the expansion element 6 substantially rising upwardly in the ground. This solution disturbs the ground surface and superficial parts as little as possible.

The structure to be supported may thus be an existing structure, such as a building 1, through the foundation of which there is provided a hole, through which are arranged the expansion element 6 and the injecting pipe 7. The solution disclosed here is particularly well suited for supporting ground-supported structures. The polymer 8 is injected through the injecting pipe and it does not react until in the expansion element 6. Consequently, the cohesion pillar 5 may be provided relatively easily to support the existing structures. FIG. 1 also shows a gravel bed 9 beneath the building 1.

In the embodiment of FIG. 1 the distance from the ground surface 3 to the rock 4 varies such that on one side of the building 1 there is compressive ground 2 between the building 1 and the rock 4 less than on the other side. So in a case like this, the cohesion pillar 5 may be arranged to compensate for the subsidence of the building 1 either on one side of the building only, or such that on one side the expansion element is longer than on the other side, as is shown in FIG. 1. Thus is prevented uneven subsidence, i.e. inclination, of the structure.

The outer diameter of the injecting pipe 7 may vary between 5 and 100 mm, whereby its inner diameter varies, for instance, between 4 and 95 mm, respectively. An example of the injecting pipe 7 is a steel pipe having an inner diameter of 12 mm. The length of the injecting pipe may vary between 1 and 20 m, for example. The injecting pipe 7 may be made of metal, such as steel, or it may also be made of some other material, such as plastic, e.g. polyethylene PE. Also, the injecting pipe 7 need not necessarily be rigid. The injecting pipe 7 may thus be a plastic hose or pipe, for example. If the injecting pipe 7 is a hose, its wall may be provided with textile reinforcement fabrics or metal or other similar reinforcements.

The wall of the expansion element 6 is thus of water permeable and preferably substantially non-stretching material, such as geotextile. It is also possible to use some other flexible and durable material. As the material of the expansion element 6 it is possible to use a plastic, such as polyester or polypropylene, or artificial fibre or natural fibre. Preferably, the wall of the expansion element is thus inelastic. The wall of the expansion element may also include metallic reinforcement material or glass fibre, or some other suitable reinforcement material. The expansion element may be provided either with seams or without seams. The seam may be made, for instance, by sewing, gluing, using an attachment element, riveting, welding, soldering, melting, or by some other mechanical, chemical, thermal or electrotechnical method or a combination thereof.

The wall thickness in the expansion element 6 may vary between 0.05 mm and 5 mm, for instance, depending on the material, size of the expansion element, expansion pressure, etc.

Before fitting the injecting pipe 7 inside the ground the expansion element 6 is wrapped or folded against the injecting pipe 7. When the expansion element 6 is full of reacted polymer 8, its outer diameter may vary between 15 cm and 1 m, for instance. Correspondingly, the length of the expansion element 6 may vary between 20 cm and 20 m, for instance. When the maximum outer diameter of the expansion element 6 is 40 cm, for instance, it can be wrapped or folded around the injecting pipe 7 such that their outer diameter is less than 40 mm, whereby the mounting of the injecting pipe 7 and the expansion element 6 in the ground is simple and easy.

The expansion element 6 may be, for instance, cylindrical when it is full of polymer 8. Further, the expansion element may be slimmer at the upper and lower ends, and the middle portion may be larger in diameter. The external form of the expansion element prior to injecting the polymer inside the expansion element 6 is irrelevant. After the polymer has reacted inside the expansion element, the expansion element 6 achieves its final shape, which is affected, in addition to the properties and the amount of the polymer 8, by the properties of the ground surrounding the expansion element.

How much water is absorbed, is determined on the basis of the shearing strength of the ground 2. Typically it is thus assumed that the lower the shearing strength of the ground, the higher its water content. The lower the shearing strength, the more the polymer is arranged to absorb water. It may be given as exemplary values that if the shearing strength of the ground 2 is e.g. less than 20 kPa, the polymer 8 is arranged to absorb water to the extent that its total mass will increase by at least 10% and if the shearing strength is e.g. less than 5 kPa, the increase in the total mass is arranged to be at least 50%.

The polymer 8, when reacted, is thus preferably elastic. Resilience may thus be elastic, i.e. recoverable, or resilience may be creep, i.e. irrecoverable. Elasticity of the cohesion pillar, i.e. the elasticity of the polymer 8 after solidification and/or hardening, may be presented as a modulus of elasticity, the magnitude of which may be 15 to 500 MPa, for instance. Preferably the modulus of elasticity is less than 300 MPa.

The desired value of the elasticity of the cohesion pillar polymer 8 may be determined on the basis of the compressibility of the ground.

If the material has a low free expansion density, i.e. its density is low, its elasticity is typically low. The elasticity of the polymer may be affected, for instance, by the amount of water absorbed. So, the elasticity of two different cohesion pillars, for instance, may be different, even though their dimensions and the polymer injected therein, and the amount thereof, are identical, but the grounds, where the cohesion pillars are located, are different in moisture content.

The polymer 8 may be, for example, a mixture mainly consisting of two components. In such a case, the first component may mainly contain polyether polyol and/or polyester polyol, for example. The second component may contain isocyanate, for instance. The volumetric ratios of the first component to the second component may vary between 0.8 to 1.2:0.8 to 1.8, for example. The polymer may further contain catalysts and water and, if desired, also other components, such as silica, rock dust, fibre reinforcements, and other possible additional and/or auxiliary agents. The use of a single-component polymer is also possible in connection with the solutions disclosed in this description.

The polymer 8 may be non-expanding, in which case its chemical reaction in the expansion element 6 typically comprises solidification and/or hardening. The polymer 8 may also be material expanding as a result of a chemical reaction, whereby the polymer 8, when reacting, expands in the expansion element 6 and, in addition to expansion, also solidifies and/or hardens as well. The polymer 8 may be arranged to expand, for instance, 1.5 to 20 times from the original volume. The material expanding as a result of a chemical reaction need not be fed into the expansion element 6 at so high hydraulic pressure as a non-expanding polymer. Thus the polymer feeding equipment may be provided simpler.

The capacity of the polymer to absorb water is affected, inter alia, by a gelling time of the polymer. So, if the polymer is desired to absorb more water, the gelling time is to be increased, for instance. It may be given as exemplary values that if in a clay ground having a shearing strength of 10 kPa, water absorption, i.e. increase in polymer total mass with water absorption, is desired to be over 50%, the gelling time is to be controlled to a value of 40 sec, for instance. When using the above-mentioned two-component substance, the water absorption may be affected by the mixture ratio of the first to the second component. If in said polymer the volumetric ratio of the first to the second component is, for instance, 1:1.25, the polymer absorbs more water than in a situation, in which the volumetric ratio of the first to the second component is 1:1.

The elasticity of the polymer 8 may be controlled by changing its density, for instance. The elasticity is thus also affected by the water content in the polymeric mixture. Thus, the desired elasticity is determined, for instance, by adjusting the amount of a foam-producing auxiliary agent or by controlling the amount of the polymer to be injected in the expansion element of a specific volumetric capacity.

The structure, for the supporting of which the above described cohesion pillar 5 is employed, may thus be a ground-supported building as illustrated in FIG. 1. Further, the structure to be supported may be such that is partly pile-supported and partly ground-supported, for instance, such that the foundation is piled and the slab of the building is ground-supported. Further, the structure to be supported may be an earth bank or a road on a cohesion ground, or another similar structure to be supported.

In some cases, the features disclosed in this application may be used as such, irrespective of other features. On the other hand, when necessary, the features disclosed in this application may be combined to provide various combinations.

It will be obvious to a person skilled in the art that as technology advances, the basic idea of the invention may be implemented in a plurality of ways. The invention and its embodiments are thus not restricted to the examples described above but may vary within the scope of the claims.

The invention claimed is:

1. A method for supporting a structure, comprising a cohesion pillar located below said structure in a surrounding ground, wherein said cohesion pillar transfers a structure load via shaft adhesion to said surrounding ground, wherein said method further comprises determining a shearing strength of said surrounding ground, wherein said cohesion pillar comprises an expansion element made from a flexible material, wherein said expansion element is filled via an injecting pipe that injects polymer into said expansion element, wherein said polymer undergoes a chemical reaction within said expansion element resulting in adhesion between said expansion element and said surrounding ground, and wherein said polymer absorbs water from said surrounding ground improving adhesion between said surrounding ground and said cohesion pillar, wherein said method further comprises determining a water absorption amount of said polymer based on said shearing strength of said surrounding ground.

2. The method of claim 1, wherein said injecting pipe remains at least partly inside said expansion element of said cohesion pillar.

3. The method of claim 1, wherein said polymer is elastic after said chemical reaction.

4. The method of claim 1, wherein said chemical reaction of said polymer generates heat such that said chemical reaction dries said surrounding ground around said cohesion pillar.

5. The method of claim 1, wherein said expansion element and said injecting pipe are arranged in an opening of an existing structure and in said surrounding ground below said existing structure, and wherein said cohesion pillar is formed below said existing structure by injecting polymer through said injecting pipe into said expansion element.

6. An arrangement for supporting a structure, said arrangement comprising a cohesion pillar, wherein said cohesion pillar transfers a structure load via shaft adhesion to a surrounding ground, wherein said cohesion pillar is located below said structure, wherein said structure is supported by said cohesion pillar, wherein said cohesion pillar comprises an expansion element made of flexible material, wherein said expansion element is filled via an injecting pipe which injects polymer into said expansion element, wherein said polymer undergoes a chemical reaction within the expansion element resulting in adhesion between said expansion element and said surrounding ground, wherein said polymer absorbs water from said surrounding ground improving adhesion between said surrounding ground and said cohesion pillar, and wherein said polymer is a water-absorbing material and said expansion element is a water-permeable material, wherein said polymer has a water absorption amount based on said shearing strength of said surrounding ground.

7. The arrangement of claim 6, wherein said cohesion pillar further comprises said injecting pipe at least partly inside said expansion element.

8. The arrangement of claim 6, wherein said polymer is elastic after said chemical reaction.

9. The arrangement of claim 6, wherein after said chemical reaction said polymer produces heat such that said cohesion pillar dries said surrounding ground.

10. The arrangement of claim 6, wherein said expansion element and said injecting pipe are arranged in an opening in an existing structure and in said surrounding ground below said existing structure.

* * * * *